US005323613A

United States Patent [19]

Akiyama

[11] Patent Number: 5,323,613

[45] Date of Patent: Jun. 28, 1994

[54] MOTOR-GENERATOR VOLTAGE CONTROLLER FOR TURBOCHARGER

[75] Inventor: Kazunari Akiyama, Sagamihara, Japan

[73] Assignee: Isuzu Motors Limited, Tokyo, Japan

[21] Appl. No.: 40,256

[22] Filed: Mar. 30, 1993

[30] Foreign Application Priority Data

Mar. 31, 1992 [JP] Japan ..... 4-105319

[51] Int. Cl.[5] ..... F02B 33/44

[52] U.S. Cl. ..... 60/608; 290/52

[58] Field of Search ..... 60/607, 608; 290/57

[56] References Cited

U.S. PATENT DOCUMENTS 4,756,377 7/1988 Kawamura et al. ..... 60/608

4,798,257 1/1989 Kawamura et al. ..... 60/608

*Primary Examiner*—Richard A. Bertsch

*Assistant Examiner*—Charles G. Freay

*Attorney, Agent, or Firm*—Staas & Halsey

[57] ABSTRACT

A motor-generator voltage controller for a turbocharger is provided with a transformer and a switching circuit mechanism. The transformer has input and output windings with the output windings being connected to the motor-generator. The input windings of the transformer have first and second portions. The winding ratio between the first portion of the input windings and the output windings is input power supply voltage: motor drive voltage. The switching circuit mechanism connects the second portion of the input windings to the input power supply when the motor-generator is operated as a motor so that the transformer functions as an invertor. The switching circuit mechanism connects the first portion of the input windings to the input powers apply when the motor-generator is operated as a generator. The motor-generator voltage controller has three transformers and three corresponding switching circuit mechanisms, one for each of a U-phase, a V-phase and a W-phase. A controller controls each of the three switching circuit mechanisms.

4 Claims, 4 Drawing Sheets

MOTOR-GENERATOR VOLTAGE CONTROLLER FOR TURBOCHARGER

BACKGROUND OF THE INVENTION

1. Field of the Invention

This invention relates to a rotating motor-generator voltage controller for a turbocharger incorporated in a motor-generator mounted on the turbocharger shaft.

2. Description of the Prior Art

Many designs have been proposed which mount a turbocharger to the exhaust of an engine and directly connect a motor-generator to the turbocharger shaft in order to recover the exhaust energy, and a number of these proposed designs have been implemented. This design fundamentally consists of a rotating motor-generator mounted to the turbocharger which functions as a motor or a generator. The operation mode changes according to the operation status of the internal combustion engine. For example, when the internal combustion engine is operating under high load, the motor-generator is operated in the motor mode, assisting compressor rotation which in turn enhances turbocharger operation. On the other hand, when the internal combustion engine is operating at a high rpm, the large volume of exhaust gas which is discharged is transfered into rotating force by the turbine which turns the compressor, and the revolving motor-generator is operated in the generator mode in order to recover the exhaust gas energy and convert it into electric energy. Design proposals of this type have been published repeatedly, as disclosed in Japanese Laid-Open Publication No. 1-155027 published by the Japanese Patent Office.

The turbocharger unit described above consists of a voltage converter which converts 12 V DC into 100 V AC, a rectifier which converts 100 V AC into 70 V DC, an inverter which converts 70 V DC power and outputs it as variable frequency 3-phase AC power, and a low-voltage rectifier which converts the 3-phase AC voltage recovered by the generator into 12 V power.

Furthermore, when the rotating motor-generator in this turbocharger is functioning as a generator, the low-voltage rectifier operates, converting the electric power generated into 12 V DC power. When the rotating motor-generator is operated as a motor to drive the compressor, the AC output with the required frequency and waveheight is obtained after a step where the 12 V DC power is boosted to 100 V AC by the voltage converter, another step where the 100 V AC power is converted to 70 V DC, and another step where the 70 V DC power is converted into 3-phase AC output, enabling operation of the rotating motor-generator as a motor.

As explained above, with conventional turbochargers, the voltage applied to the motor had to be converted from DC to AC to DC to AC when the rotating motor-generator was operated as a motor, requiring an extremely complicated circuitry configuration. This inevitably led to high production costs, a high level of difficulty to perform assembly and adjustment, and large dimensions.

SUMMARY OF THE INVENTION

It is an object of the invention to solve a number of the problems inherent in conventional configurations, enabling the rotating motor-generator voltage controller for turbocharger which is incorporated in the motor-generator mounted on the turbocharger shaft to be made more compact and simple in design, facilitating operation as a motor, and representing a rotating motor-generator voltage controller which is easier to assemble and adjust.

In order to achieve the above objectives of the present invention, the rotating motor-generator voltage controller for turbocharger which is incorporated in the motor-generator mounted on the turbocharger shaft has a transformer (with an "Input voltage: Motor drive voltage" winding ratio) connected to the output side of the respective switching circuits of the inverter when the motor-generator is operated as a motor.

When the rotating motor-generator is operated as a motor, the transformer (which has an "Input voltage: Motor drive voltage" winding ratio and is connected to the output side of the respective switching circuits of the inverter) raises the voltage input to the switching circuits to the required level to drive the motor.

DESCRIPTION OF THE PREFERRED EMBODIMENTS

Next, an implementation example of this invention will be explained in detail using the drawings.

Figure 2:
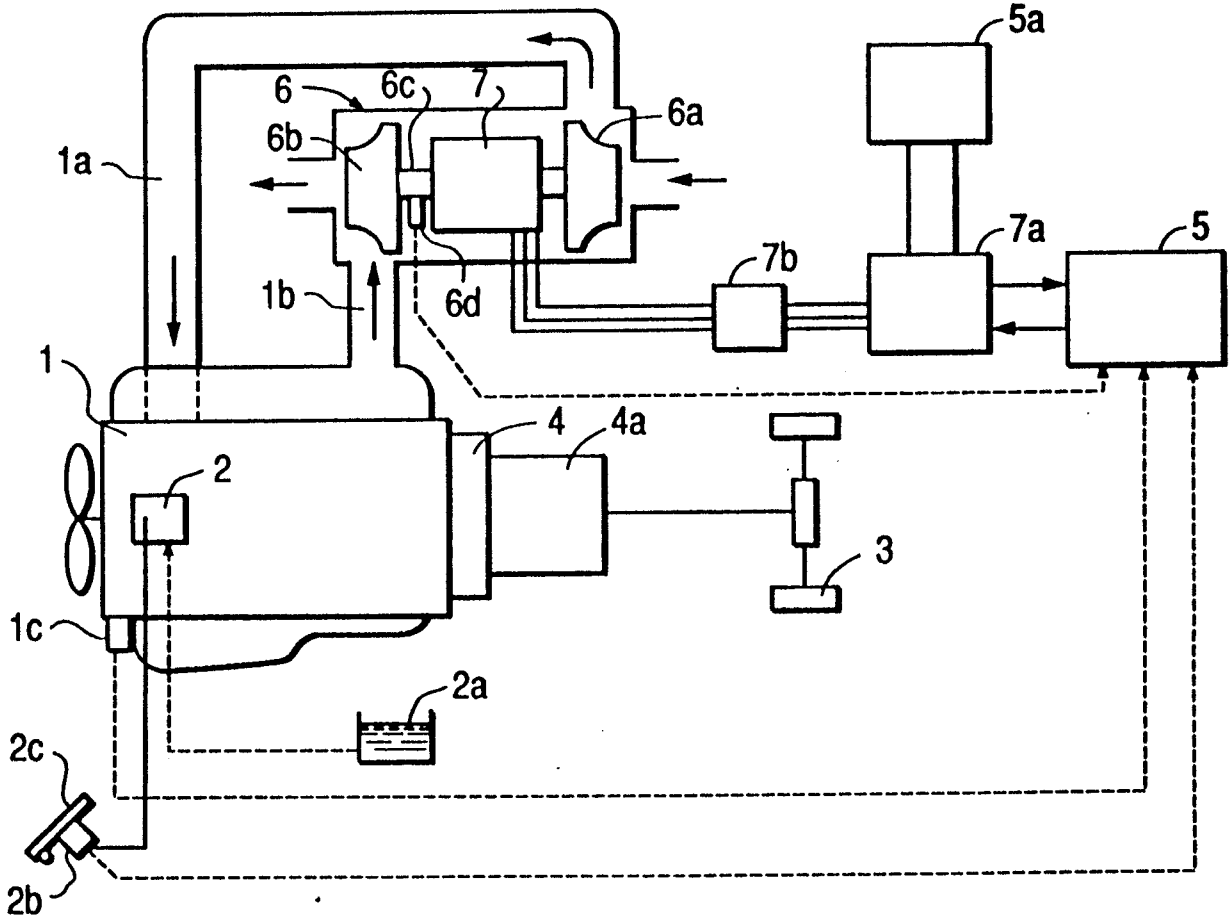
FIG. 2 is a block diagram for the overall turbocharger, including the rotating motor-generator voltage controller covered by this invention.

FIG. 2 is a block diagram for the overall turbocharger, including the rotating motor-generator voltage controller for turbocharger covered by this invention. In FIG. 2, (1) denotes the engine. The air which enters through the intake (1*a*) and fuel fed from the fuel tank (2*a*) through the injectors (2) create combustion energy to rotate the wheels (3) and in turn drive the vehicle. After combustion, the exhaust gas is discharged through the exhaust (1*b*). The engine (1) is also provided with a clutch (4) which interrupts the engine torque, and a transmission (4*a*) which changes the speed of engine torque. Furthermore, (1*c*) denote the engine rpm sensor and (2*b*) denotes the accelerator pedal sensor which is mounted to the accelerator pedal (2*c*).

These sensors respectively send an engine rpm signal and engine load signal corresponding to the accelerator depression volume to the electronic controller (5).

(6) denotes the turbocharger which is connected to the exhaust (1*b*) and intake (1*a*), having a turbine (6*b*) which is driven by the exhaust gas energy and a compressor (6*a*) which turbocharges the air. The rotating motor-generator which functions as a motor or generator is mounted to the shaft (6*c*) which connects the turbine and compressor. When the turbine (6*b*) is rotated by the exhaust energy, the rotating motor-generator (7) operates in the generator mode, and the electrical power generated is sent to the power transformer (7a), which charges the vehicle battery (5a). The power transformer (7a) is provided with an inverter to operate the rotating motor-generator in the motor mode, and a low-voltage rectifier which converts the 3-phase AC voltage recovered by the rotating motor-generator (7) when it functions as a generator into 12 V DC power.

Figure 1:
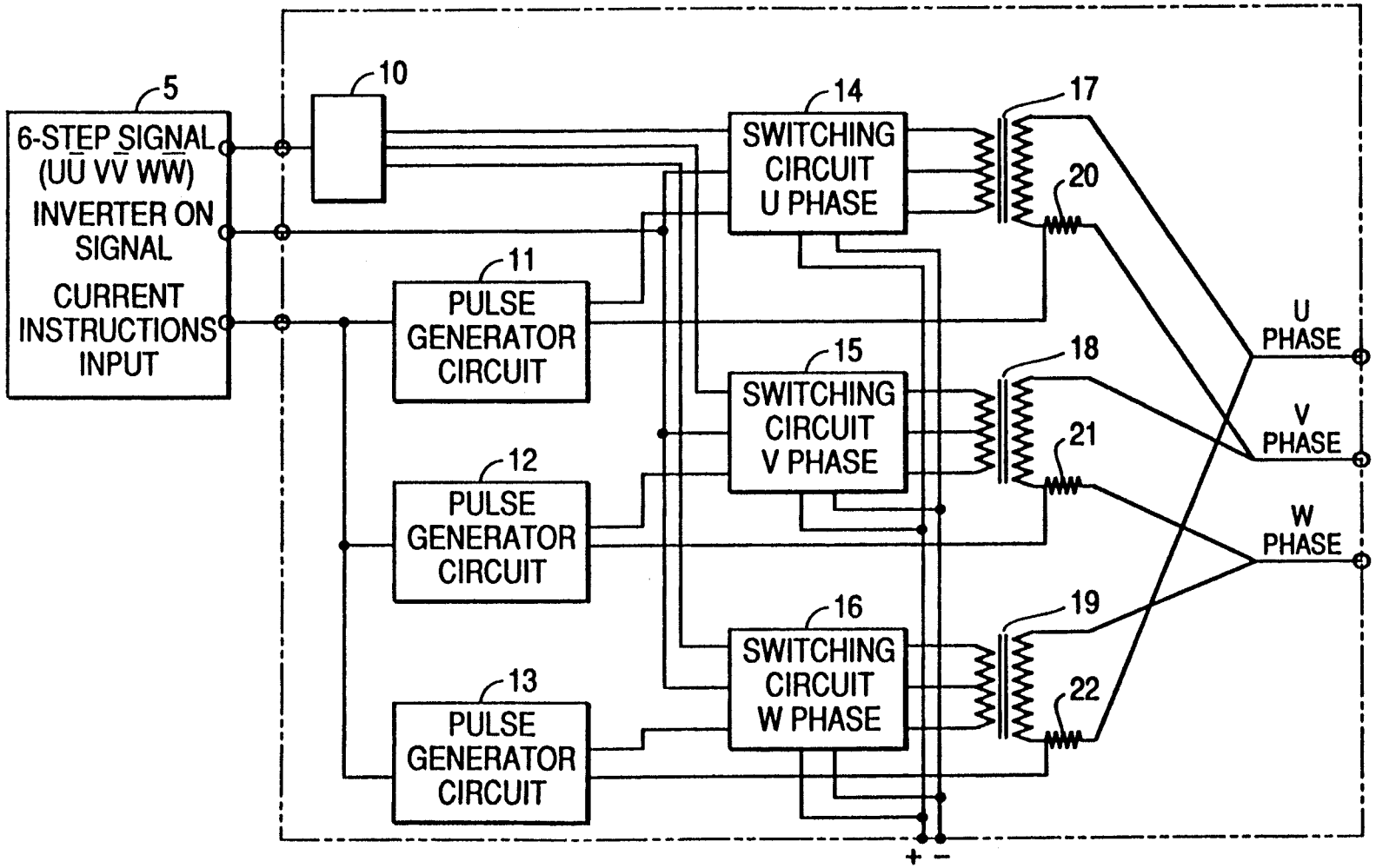
FIG. 1 is a block line diagram which indicates the details of the inverter.
Figure 3:
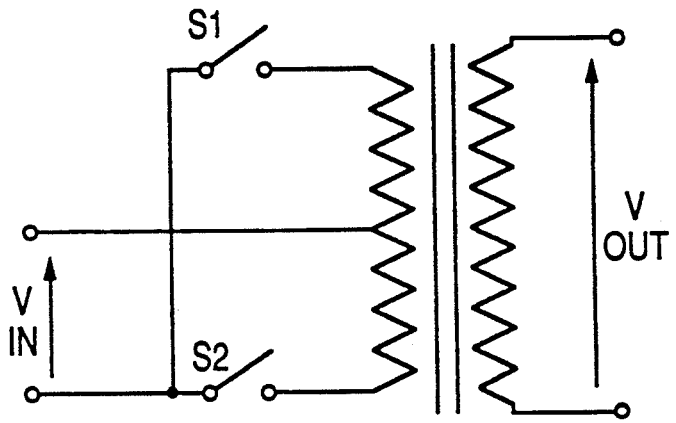
FIG. 3 is a circuit diagram which describes the inside of the switching circuits and the transformer.

FIG. 1 is a block diagram which shows the details of the inverter provided within the power transformer (7a). In FIG. 1, (10) denotes the interface circuit which receives the 6-step signal sent by the electronic controller (5). The 6-step signal is a signal which turns the switching circuits described later on and off. (11), (12) and (13) denote pulse-width modulation type pulse generators, which generate a pulse-width proportional to the size of the primary current which should be supplied to the motor. The size of this primary current corresponds to the current specification input from the electronic controller (5). Furthermore, pulse generator circuit (11) is the U phase, pulse generator circuit (12) is the V phase, and pulse generator circuit (13) is the W phase. (14), (15) and (16) denote switching circuits, the inside of which are provided with two switching elements S1 and S2 as shown in FIG. 3.

The switching element which functions is specified by the 6-step signal which was earlier described, and the pulse duty width is determined by the specification from the pulse generation circuits (11) to (13). Switching circuit (14) is the U phase, switching circuit (15) is the V phase, and switching circuit (16) is the W phase. Furthermore, these switching circuits start to function when they receive an inverter On signal from the electronic controller, and stop functioning when they receive an Switch-Off signal. (17) to (19) denote transformers, and the respective winding ratios are the input voltage: motor drive voltage.

Figure 4:
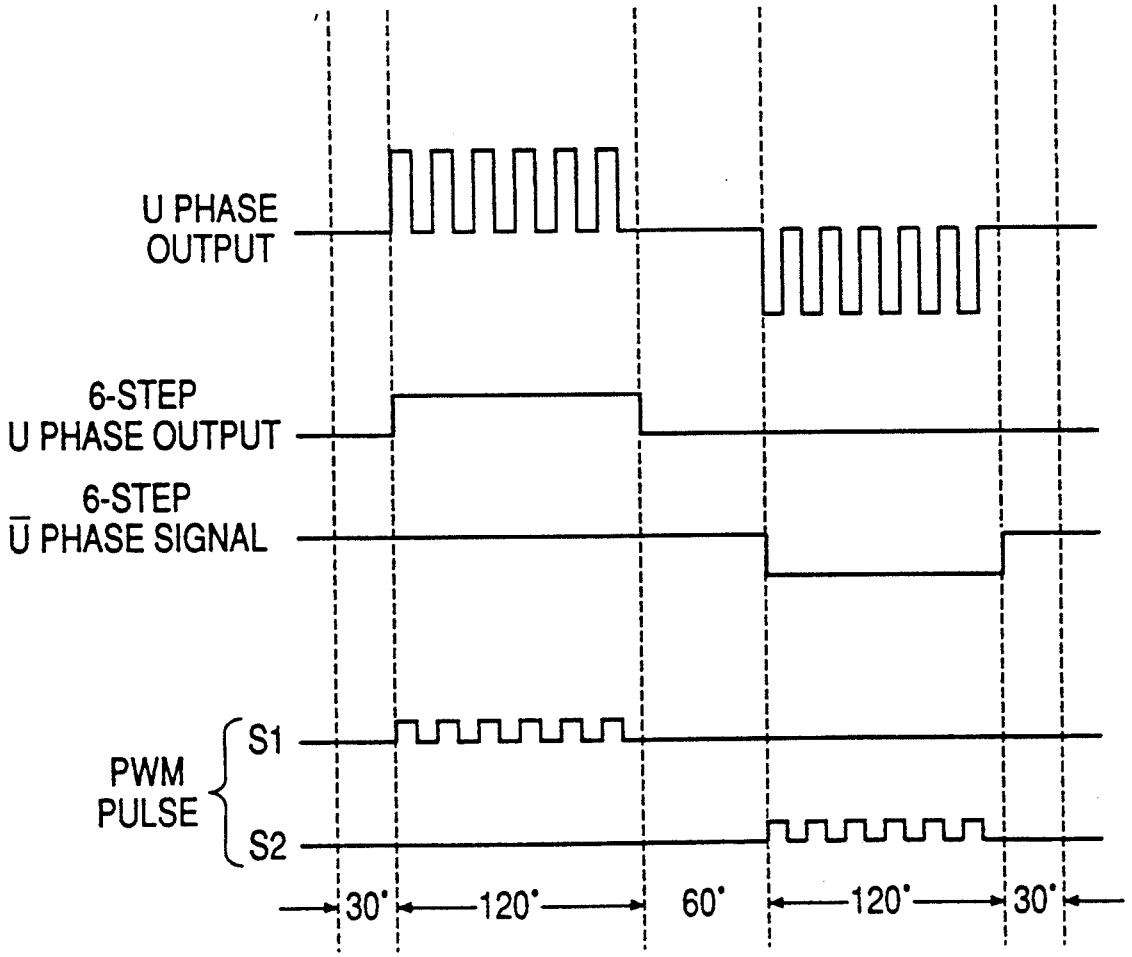
FIG. 4 is a waveform diagram which describes the output waveform of one phase of the U phase, the U-phase signal and U-bar phase signal of the 6-step signal, and the on-off status of the S1 and S2 switching elements of the switching circuits.
Figure 5:
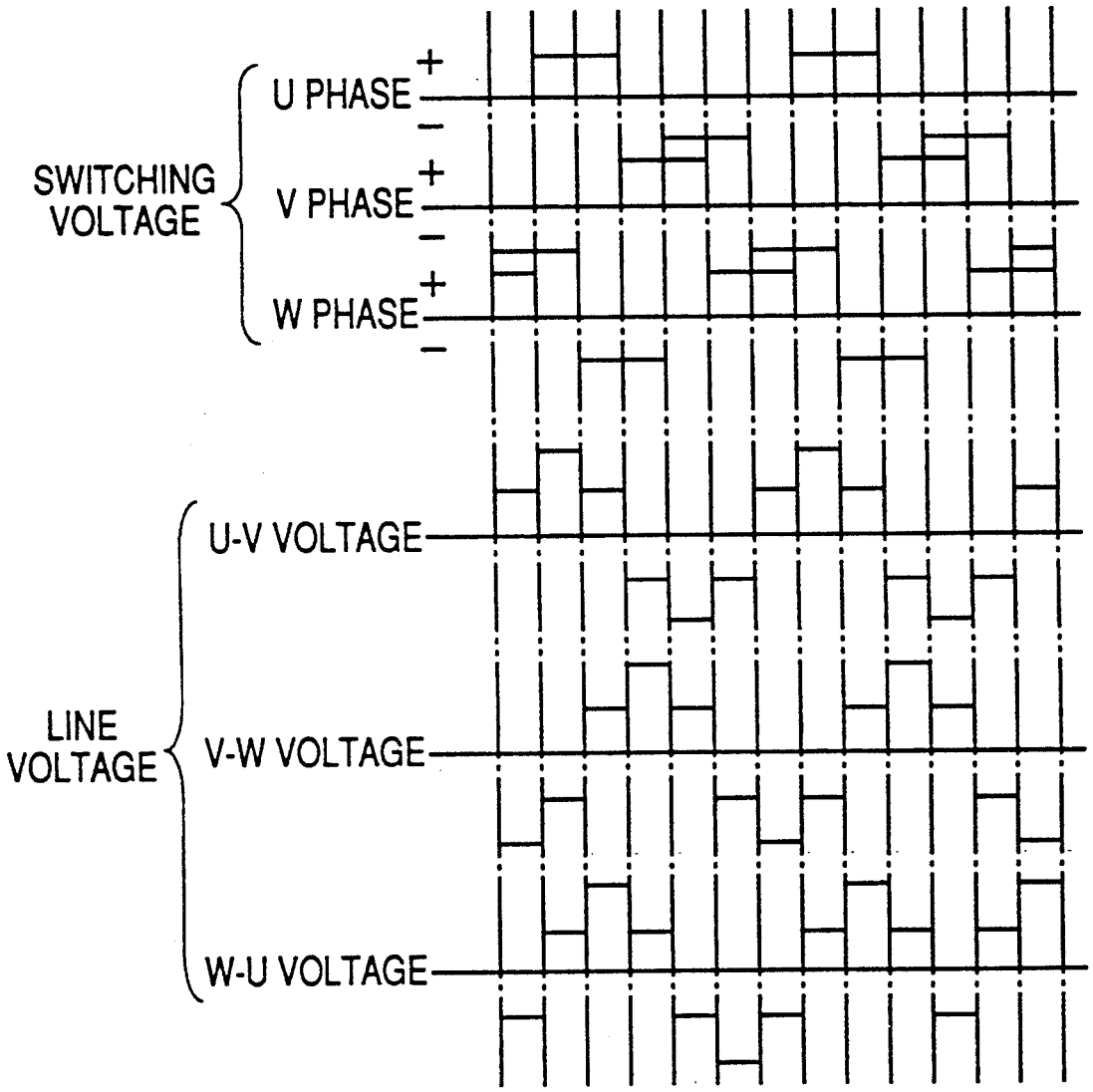
FIG. 5 is a waveform diagram which indicates the voltage conversion status of the U-phase, V-phase and W-phase, and the voltage conversion status between the lines for the three phases.

Transformer (17) is the U phase, transformer (18) is the V phase, and transformer (19) is the W phase. Current sensors (20) to (22) are provided on the secondary side of these transformers, the value detected by the current sensors is returned to the pulse generation circuit for the respective phase, and the secondary side current value for these transformers is retained in the command value. The secondary sides of the transformers are connected to three phases, creating the U phase, V phase and W phase. FIG. 4 is a waveform diagram which shows the output waveform for 1 phase of the U phase, the U-phase signal and U-bar phase signal for the 6-step signal, and the switch on-switch off status of the S1 and S2 switching elements of the switching circuits. FIG. 5 is a waveform diagram which indicates the voltage conversion status of the U-phase, V-phase and W-phase, and the voltage conversion status between the lines for the three phases.

The present invention is explained using the above implementation example, but it is not limited to this embodiment, and may be modified and applied in a number of different ways within the scope of this invention, and these modifications and varied applications are not to be excluded from the scope of the present invention.

As explained in detail above, this invention covers a rotating motor-generator voltage controller for a turbocharger incorporated in a motor-generator mounted to the turbocharger shaft. When the rotating motor-generator is operated as a motor, a transformer (which has an input voltage: motor drive voltage winding ratio) is connected to the output side of the respective switching circuits of the inverter. Differing from conventional inverters, this device does not have a extremely complicated circuit configuration where the voltage applied to the motor is changed from DC to AC to DC to AC. This achieves a compact and simple configuration for operation of the motor-generator as a motor, providing a rotating motor-generator voltage controller for turbocharger which can be easily assembled and adjusted.

What is claimed is:

1. A motor-generator voltage controller for a turbocharger, comprising:

a transformer having input and output windings, the output windings being connected to the motor-generator, the input windings having first and second portions, the winding ratio between the first portion of the input windings and the output windings being input power supply voltage: motor drive voltage; and switching circuit means for connecting the second portion of the input windings to the input power supply when the motor-generator is operated as a motor so that the transformer functions as an inverter, and for connecting the first portion of the input windings to the input power supply when the motor-generator is operated as a generator.

2. A motor-generator according to claim 1, wherein the winding ratio between the second portion of the input windings and the output windings is input power supply voltage: motor drive voltage.

3. A motor-generator according to claim 1, wherein there are three transformers and three corresponding switching circuit means, one for each of a U phase, a V phase and a W phase.

4. A motor-generator according to claim 3, further comprising a controller for controlling each of the three switching circuit means.

* * * * *